US005551841A

United States Patent [19]

Kamada

[11] Patent Number: 5,551,841

[45] Date of Patent: Sep. 3, 1996

[54] AXIAL-FLOW FAN

[75] Inventor: Kenji Kamada, Kadoma, Japan

[73] Assignee: Marsushita Electric Works, Ltd., Osaka, Japan

[21] Appl. No.: 492,522

[22] Filed: Jun. 20, 1995

[30] Foreign Application Priority Data

Jun. 27, 1994 [JP] Japan ..... 6-145160

[51] Int. Cl.[6] ..... F04D 29/54

[52] U.S. Cl. ..... 417/89; 415/220; 415/182.1

[58] Field of Search ..... 417/89, 80; 415/182.5, 415/220, 914

[56] References Cited

U.S. PATENT DOCUMENTS

| | | | |
|---|---|---|---|
| 2,215,901 | 9/1940 | Christman | 417/89 X |
| 2,991,927 | 7/1961 | Quick | 415/182.1 X |
| 4,871,294 | 10/1989 | Ivanov et al. | 415/914 X |

FOREIGN PATENT DOCUMENTS

| | | | |
|---|---|---|---|
| 2/5799 | 10/1990 | Japan . | |
| 637555 | 12/1978 | U.S.S.R. | 417/89 |

*Primary Examiner*—Richard E. Gluck

*Attorney, Agent, or Firm*—Burns, Doane, Swecker & Mathis, L.L.P.

[57] ABSTRACT

An axial-flow fan includes a cylindrical casing having an inlet port at one axial end and an outlet port at the other axial end, and in which a motor for driving vanes is mounted. The casing is further provided at the inlet port with an inside wall member defining an annular flow path between opposing peripheries of the casing and the inside wall member. The path has its own inlet and outlet, the outlet disposed in a plane oriented perpendicular to the longitudinal axis of the casing. The annular flow path provides a peripheral air flow along the inner periphery of the casing towards the outer peripheral edges of the vanes to oppose the creation of a leakage swirl around the outer edges of the vanes.

8 Claims, 4 Drawing Sheets

AXIAL-FLOW FAN

BACKGROUND OF THE INVENTION

This invention relates to an axial-flow fan for use in hair driers and the like and, in particular, to an arrangement for a noise reduction of the axial-flow fan.

DESCRIPTION OF RELATED ART

The axial-flow fans of the type referred to in general have been described in Japanese Patent Laid-Open Publication No. 2-5799 and so on, and also measures for preventing a back flow from occurring in a low flow-rate zone have been suggested, an example of which measures is a reflux arrangement for the back flow generated at outer peripheral edges of vanes of the fan to an extra air flow path.

However, while the above referenced known measure is effective in the low flow-rate zone where the back flow is generated, a required member for forming the extra air flow path will be a resistive member in a low pressure zone where no back flow is generated, so as to cause a risk of generating a turbulence in the air flow to arise.

Further, even in the low pressure zone where the back flow is not generated, there occurs an air stream along vanes' surface not only in the axial direction but also in radial directions, and such radially directional air stream is to leak from outer peripheral tip end edges of the vanes so as to cause a leakage swirl which will be a cause of increments in the noise of the axial-flow fan and of decrements in the efficiency.

SUMMARY OF THE INVENTION

A primary object of the present invention is, therefore, to provide an axial-flow fan which has eliminated the foregoing problems and is capable of reducing the leakage swirl generated at the outer peripheral tip end edges of the vanes of the fan, preventing the efficiency from being lowered, and reducing the noise.

According to the present invention, the above object can be realized by means of an axial-flow fan comprising a cylindrical casing having at an upstream side end a first inlet port and at the other downstream side end an outlet port, a fan rotatably disposed within the casing, a motor for driving the fan, stabilizer wings disposed within the casing on the downstream side for supporting the motor with respect to inner wall surface of the casing and stabilizing air flow generated by the fan driven, and an inner side wall disposed inside the casing on upstream side of the fan and adjacent to outer peripheral edge of the fan, the inner side wall defining between the inner periphery of the casing and the outer periphery of the inner side wall an annular flow path having a discharge aperture on the side of the fan and expanding on a plane substantially perpendicular to the air flow and a second inlet port on upstream side of the casing to be remote from the fan, and the inner side wall thus forming a central main flow and an outer peripheral extra flow.

In this case, it is preferable to provide the inner side wall so that upstream side aperture forming the second inlet port of the annular path is opened in radial directions of the casing. It is also preferable that the outer peripheral edge of the fan is arranged to be within an opening area of the discharge aperture of the annular path including the second inlet port as viewed in the direction of air flow.

According to the foregoing arrangement of the present invention, there are generated the main and extra air flows while the fan is driven to rotate for drawing air primarily from the first inlet port and forming the main air flow to be discharged from the outlet port, since the inner side wall is provided as disposed inside the casing to be adjacent to the outer periphery of the fan on the upstream side of the main air flow, so as to form the annular flow path having the second inlet port between the inner periphery of the casing and the outer periphery of the inner side wall, with the discharge aperture on the fan side of the path expanded in the direction substantially perpendicular to the direction of the main air flow and the second inlet port of the path remote from the fan positioned on the upstream side of the casing, so that air will flow on the outer peripheral side of the fan separately from the main air stream, from the second intake port through the path 9 out of the discharge aperture 10. The leakage swirl at the outer periphery of the fan is thereby prevented from occurring, and it is enabled to restrain any decrement of the operational efficiency of the fan and any increase in the noise.

Further, with the formation of the inner side wall for rendering the second inlet port of the path to be opened in the radial directions of the casing 1, an air flow reliably separated from the main air flow can be generated, so that the operational efficiency of the fan can be further improved. With the outer periphery of the fan positioned within the range of the opening of the discharge aperture of the path as viewed in the direction of the air flow, the air is made to be discharged to the outer periphery of the fan, and the generation of the leakage swirl can be further prevented.

Further, with such positional relationship that the inner side wall forming the path 9 overlaps the casing, the air flow through the path is directed in the axial direction, and the generation of the leakage swirl can be reduced. It is also made possible to smooth air inflow through the path by forming the path to have a cross sectional area sequentially enlarged from the discharge aperture 10 towards the second inlet port 11 or substantially kept constant, and the effect made obtainable by the present invention can be further increased.

The effect can be further increased over the whole circumference of the fan 4 by disposing the discharge aperture 10 on a circle coaxial with the casing. With radial provision of fins within the path, it is also enabled to optimumly stabilize the air flow led into the path.

Other objects and advantages of the present invention shall become clear as the description of the invention advances as detailed with reference to preferred embodiments shown in accompanying drawings.

While the present invention shall now be described with reference to the preferred embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Figure 1:
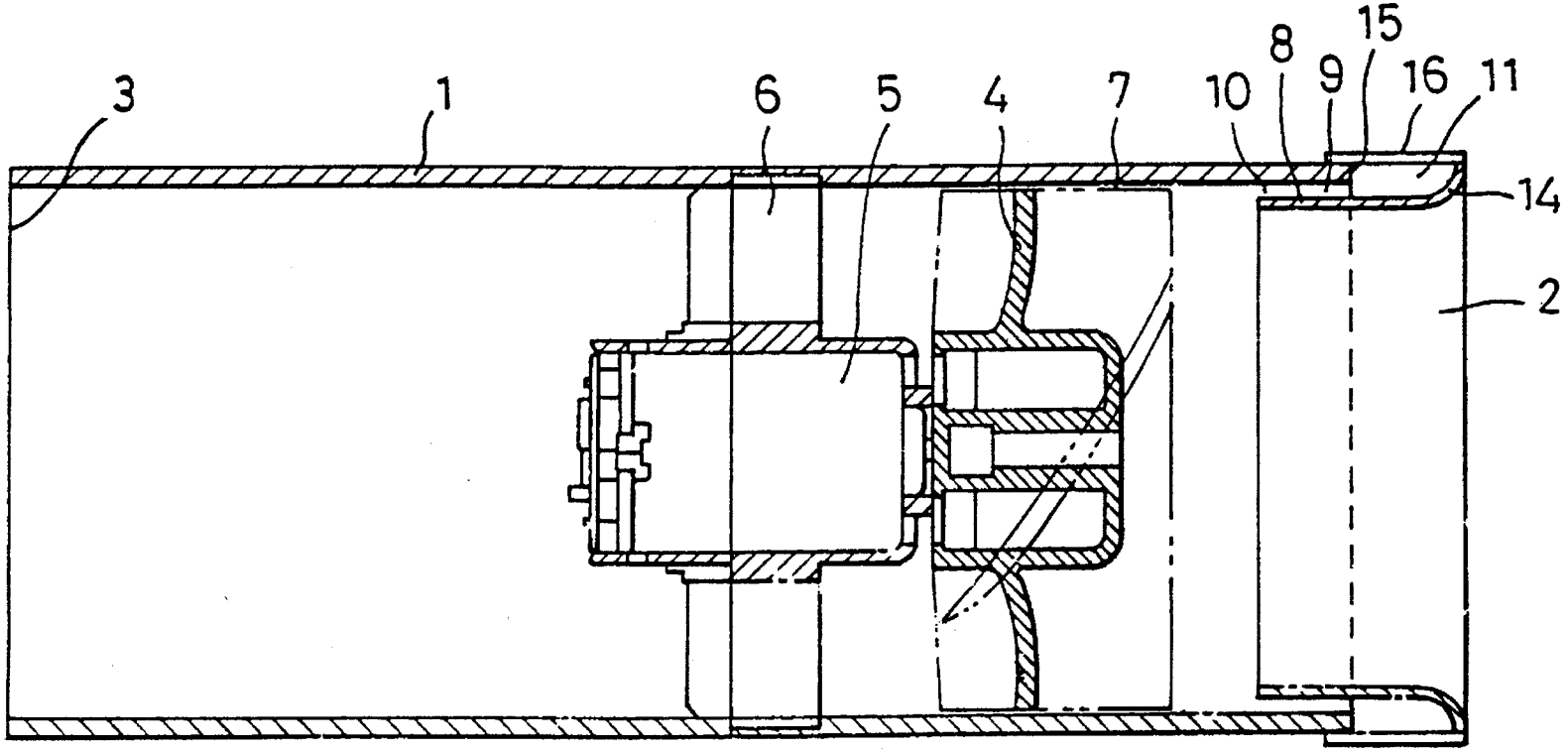
FIG. 1 is a vertically sectioned view of the axial-flow fan in an embodiment according to the present invention.

As shown in FIG. 1, the axial-flow fan in this embodiment according to the present invention comprises a casing 1 formed in a cylindrical shape, of which an aperture at a front side or upstream end is made as a first inlet port 2 and the other aperture at a rear side or downstream end is provided as an outlet port 3. Inside the casing 1, a fan 4, motor 5 for driving the fan 4, and stabilizer fins 6 functioning to support the motor 5 with respect to the inner periphery of the casing 1 and stabilizing the air flow generated by the fan 4 are disposed. The fan 4 comprises a plurality of vanes 7, the motor 5 is secured to the stabilizer fins 6, and the stabilizer fins 6 are fixed to the casing 1. When the fan 4 is driven by the motor 5, air is drawn into the first inlet port 2 and discharged out of the outlet port 3, so as to form a main flow D of air.

On the inner periphery of the casing 1, there is provided at the upstream end a coaxially telescoping inside wall member 8 spaced inwardly from the casing by a predetermined space from the inner periphery of the casing 1 to form an annular flow path 9 having a second inlet port 11. In the present instance, the inside wall member 8 is provided in a cylindrical shape to be coaxial with the casing 1, and the path 9 having the second inlet port 11 is also made cylindrical. An inner discharge aperture 10 of the path 9 lies in a plane perpendicular to the direction of the air flow and is faces the outer periphery of the vanes 7 of the fan. The second inlet port 11 is opened to draw air in a separate annular path from the main air flow D. The air drawn from the second inlet port 11 passes through the path 9 as shown by an arrow line E in FIG. 2A and is discharged from the inner discharge aperture 10 towards the outer periphery of the vanes 7 of the fan 4 as a peripheral air flow along the inner periphery of the casing, so that a leakage swirl is prevented from occurring adjacent to the outer peripheral tip ends of the vanes 7 of the fan 4. In the foregoing arrangement of Japanese Patent Laid-Open Publication No. 2-5799 having the back flow preventing means is provided simply as projected from a peripheral part into the flow path, as shown in FIG. 2B, the means can function to restrain the back flow generated in the low flow rate zone but will be an obstacle to the air flow in the low pressure zone. It should be appreciated that this problem is effectively eliminated according to the present invention. When in this case the inside wall member 8 is disposed too close to the fan 4, the wall member will be a cause of the noise and is thus kept no closer than required. In the present embodiment, the distance between the fan 4 and the inside wall member 8 is set to be about 15% of outer diameter of the fan 4. An inlet port edge 14 of the inside wall member 8 is disposed upstream from the inlet port edge of the casing 1.

Further, the inlet port edge 14 of the inside wall member 8 is provided in a bell-mouth shape, and the second inlet port 11 is opened radially outward. With such radially outward opening of the second inlet port 11, it is possible to draw the air definitely separate from the main air flow.

Figure 2A:
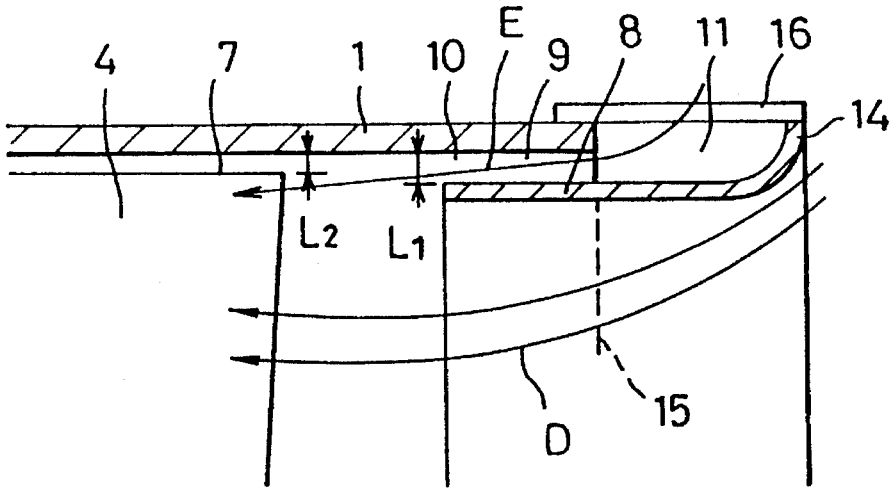
FIG. 2A is a fragmentary sectioned view as magnified showing a main part of the axial-flow fan of FIG. 1.
Figure 2B:
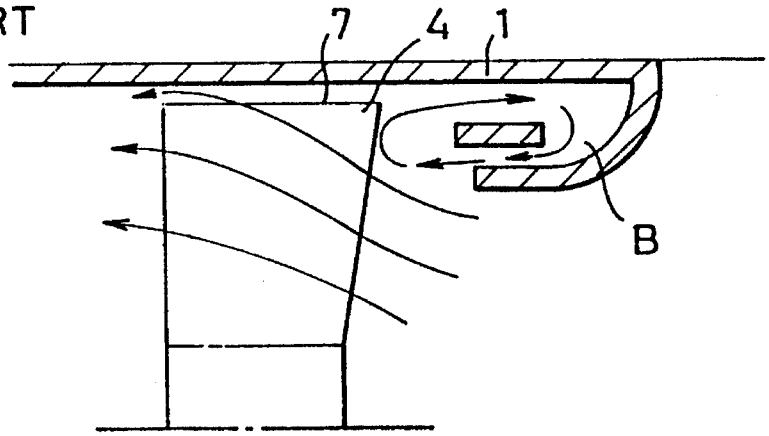
FIG. 2B PRIOR ART
FIG. 2B is a view similar to FIG. 2A of a prior art arrangement.

Further, as shown in FIG. 2A, the outer periphery of the fan 4 lies between radially inner and outer boundaries of the discharge aperture 10 of the annular path 9, as viewed in the direction of air flow (i.e., L1>L2). With this arrangement, the peripheral air flow from the annular flow path 9 is led to the outer periphery of the vanes of the fan 4, and a leakage swirl can be effectively prevented from occurring. Further, as the inside wall member 8 axially overlaps the casing 1, the air flow in the path 9 is directed in the axial direction and the generation of the leakage swirl can be effectively prevented. At this time, it is preferable that the overlapping length of the inside wall member 8 and the casing 1 is about 15% of the outer diameter of the fan 4. Further, the distance L1 between the outer periphery of the inside wall member 8 and the inner periphery of the casing 1 is made about 1/30 of the outer diameter of the fan 4, while a distance L2 between the outer peripheral tip end edges of the fan 4 and the inner periphery of the casing 1 will be about 1/60 of the outer diameter of the fan 4.

Figure 3:
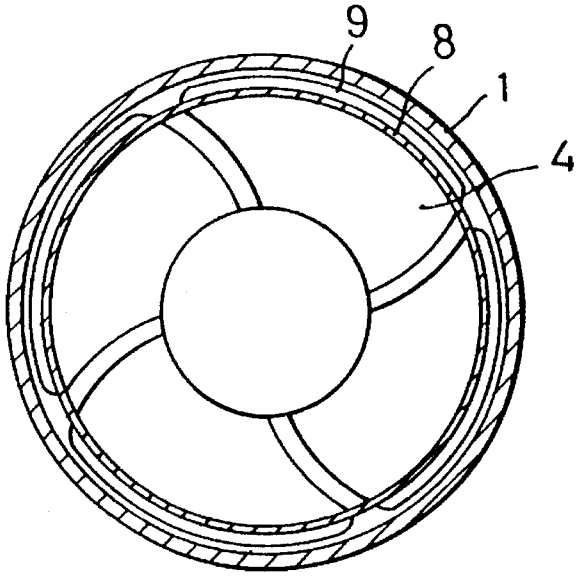
FIG. 3 is a cross sectioned view of the axial-flow fan of FIG. 1 as viewed from upstream side thereof.

The inlet port 11 of the path 9 is made to have an area larger than the area of the discharge aperture 10 to smoothen the air flow through the path 9. Mounting the inside wall member 8 to an inlet edge 15 of the casing, to the casing 1 through is achieved by a plurality of ribs 16 provided across the second inlet port 11. It should be assumed that the opening area is not unduly reduced by the ribs 16. As shown in FIG. 3, on the other hand, the path 9 as well as the second inlet port 11 are disposed to be coaxial with the fan 4, and a leakage swirl can be reliably prevented from occurring over the entire circumference of the fan 4.

As has been described, the generation of a leakage swirl at the outer periphery of the fan 4, and the associated noise, can be restrained by the peripheral air flow shown by the arrow E through the annular path 9 from second inlet port 11, whereby any turbulence in the air flow can be reduced and an effective prevention of any reduction in the blast efficiency and of any increase in the noise can be realized.

Figure 4A:
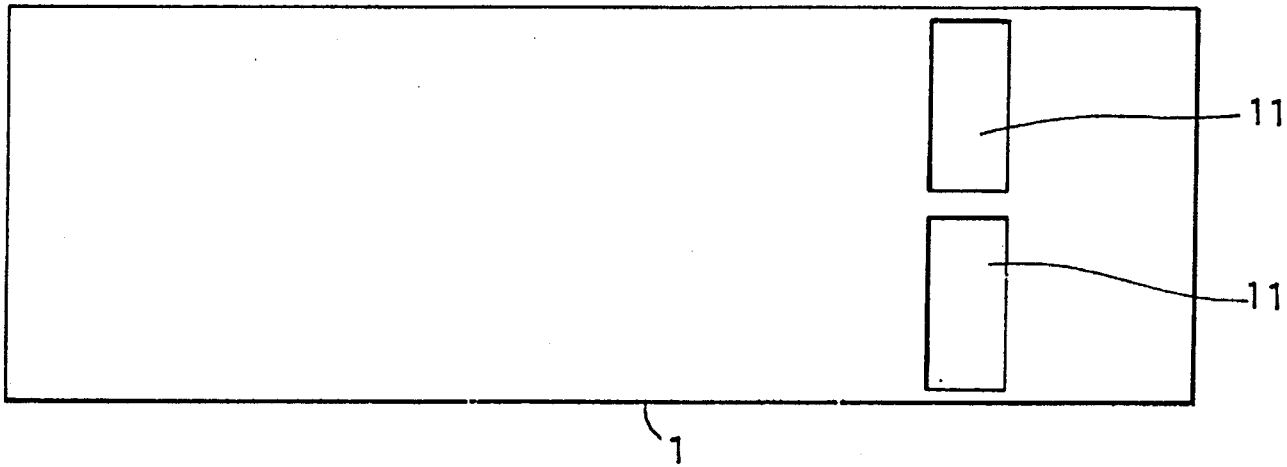
FIG. 4A is a side view of the axial-flow fan in another embodiment according to the present invention.
Figure 4B:
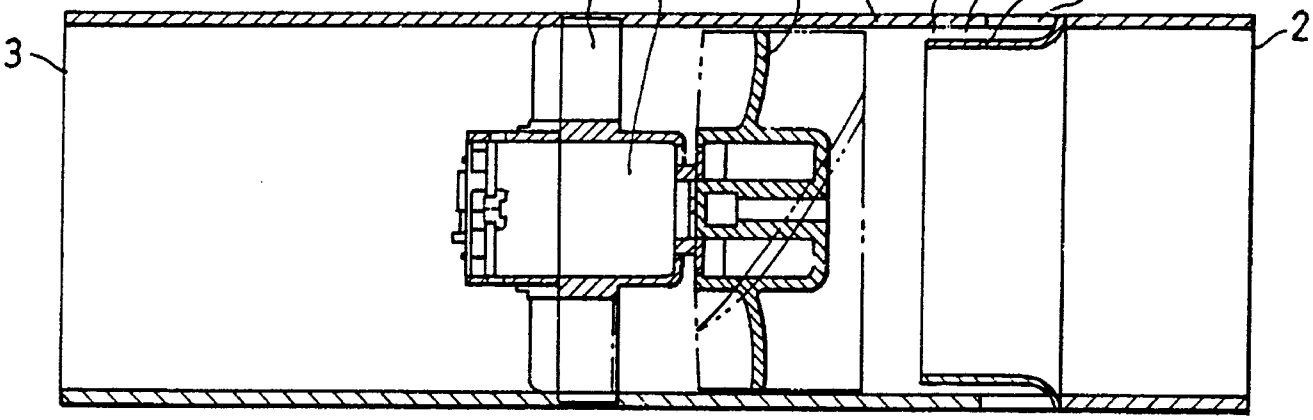
FIG. 4B is a vertically sectioned view of the fan in FIG. 4A.

In FIGS. 4A, 4B, there is shown another embodiment, in which the casing 1 is elongated, and the inside wall member 8 is provided adjacent the inner periphery of the casing 1 axially between the first inlet port 2 formed by an axial end of the casing, and the fan 4, to thereby form the annular flow path 9. In this case, the inlet port 11 is formed by perforations made in the casing 1. In this event, too, a leakage swirl generation can be prevented in the same manner as in the foregoing embodiment and the same effect as in the foregoing can be attained.

Figure 5:
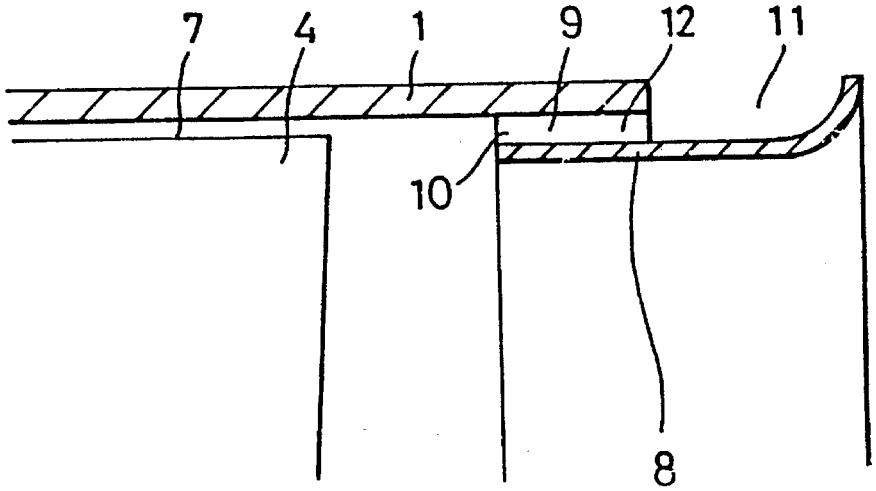
FIG. 5 is a fragmentary sectioned view as magnified showing a main part of the fan of FIG. 4A.

In FIG. 5, there is shown a further embodiment, in which the inside wall member 8 is secured to the casing 1 through a plurality of radial fins 12 lying in the annular flow path 9, leaving the second inlet port 11 fully opened. In this case, the fins 12 are effective to stabilize the air flow in the path 9, and any turbulence of the air flow can be well prevented from occurring.

Figure 6:
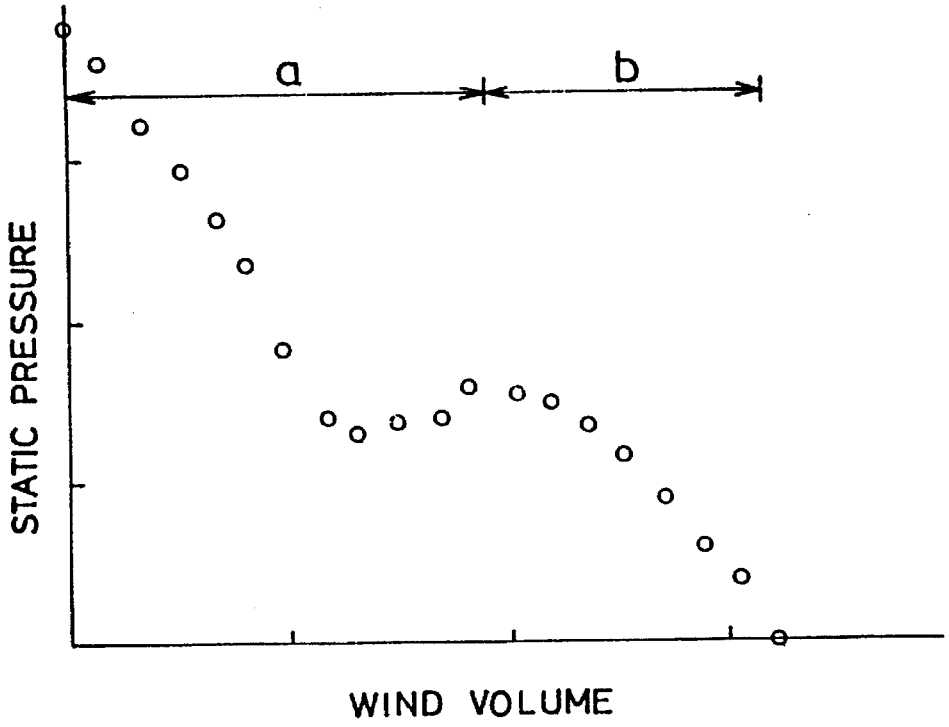
FIG. 6 is a explanatory diagram for showing characteristics of the static pressure and wind volume in the embodiments of the present invention.

Generally, the relationship between the static pressure and the wind volume in the axial-flow fan is as shown in FIG. 6, whereas, according to the featured arrangement of the present invention, a back flow can be effectively prevented from occurring in the low flow rate zone a in FIG. 6 and the air flow effect in the low pressure zone b in FIG. 6 can be excellently maintained, while effectively reducing the noise due to the rotation of the fan.

What is claimed is:

1. An axial-flow fan comprising a cylindrical casing having an inlet port at an upstream end thereof, and an outlet port at a downstream end thereof; a motor disposed within the casing; stabilizer fins connecting the motor to an inner periphery of the casing; generally radially extending vanes mounted to the motor to be rotated thereby about an axis coinciding with a longitudinal axis of the casing; an inside wall member disposed within the casing upstream of the vanes and situated coaxially with respect to the casing at a radial inward spacing from the inner periphery of the casing to form therewith an annular flow path; the annular flow path having a generally radially outwardly facing inlet opening, and a generally axially facing outlet opening lying in a plane disposed substantially perpendicular to the longitudinal axis; a first radial distance between the inner periphery of the casing and radially outer edges of the vanes being no greater than a second radial distance between the inner periphery of the casing and the inside wall member; rotation of the vanes producing a main air flow from the inlet port to the outlet port of the casing, and a peripheral air flow from the inlet opening to the outlet opening of the annular path for opposing the creation of a leakage swirl and accompanying noise around the outer edges of the vanes.

2. The fan according to claim 1 wherein the first radial distance is less than the second radial distance.

3. The fan according to claim 1 wherein the inside wall member has a radially outwardly expanding upstream end forming a bell-mouth shape; the upstream end of the inside wall member extending axially past the upstream end of the casing.

4. The fan according to claim 3 wherein the inside wall member is mounted to the casing by a plurality of ribs extending parallel to the longitudinal axis from the upstream end of the casing to the radially expanding upstream end of the inside wall member.

5. The fan according to claim 3 wherein the inside wall member is mounted to the casing by a plurality of radial ribs extending from the inner periphery of the casing to the outer periphery of the inside wall member.

6. The fan according to claim 1 wherein the inside wall member has a radially outwardly expanding upstream end forming a bell-mouth shape; the radially expanding upstream end being secured to the inner periphery of the casing at a position between the vanes and the upstream end of the casing; the casing including circumferentially spaced apertures located downstream with respect to the upstream end of the inside wall member to form the inlet opening for the annular flow path.

7. The fan according to claim 1 wherein said annular flow path has a cross sectional area sequentially enlarged from said outlet opening to said inlet opening.

8. The fan according to claim 1 wherein said annular flow path has a cross sectional area substantially constant from said outlet opening to said inlet opening.

* * * * *